United States Patent [19]

Nelson et al.

[11] Patent Number: 4,633,232

[45] Date of Patent: Dec. 30, 1986

[54] ALARM DEVICE

[75] Inventors: Frederic P. Nelson, 17 S. 1st St. #1402A, Minneapolis, Minn. 55401; John R. Jamieson, Minneapolis, Minn.

[73] Assignee: Frederic P. Nelson, Minneapolis, Minn.

[21] Appl. No.: 595,424

[22] Filed: Mar. 30, 1984

[51] Int. Cl.[4] ..... G08B 13/00; G08B 13/08; G08B 13/14

[52] U.S. Cl. ..... 340/542; 200/61.67; 200/61.93; 340/546; 340/571; 340/574; 340/687; 340/689

[58] Field of Search ..... 340/574, 571, 546, 542, 340/689, 541, 686-687; 116/77, 78-81; 200/61.62, 61.64, 61.67, 61.68, 61.93; 292/289, 288; 70/DIG. 49

[56] References Cited

U.S. PATENT DOCUMENTS

| | | | |
|---|---|---|---|
| 452,597 | 5/1891 | Davis . | |
| 577,154 | 2/1897 | Walters . | |
| 583,952 | 6/1897 | Sutton . | |
| 712,005 | 10/1902 | Reynolds . | |
| 713,782 | 11/1902 | MacDonald . | |
| 732,727 | 7/1903 | Fletcher . | |
| 804,241 | 11/1905 | Love . | |
| 1,305,190 | 5/1919 | Bobo . | |
| 1,419,954 | 6/1922 | Brichetto . | |
| 1,545,947 | 4/1925 | Davies . | |
| 1,567,921 | 12/1925 | D'Almaforte . | |
| 2,135,476 | 10/1934 | Rugh | 340/574 X |
| 2,259,696 | 10/1941 | Hulst | 340/546 |
| 2,679,039 | 5/1954 | Koppl | 340/686 X |
| 3,248,723 | 4/1966 | Miethe | 340/689 X |
| 3,261,010 | 7/1966 | Kardel | 340/546 |
| 3,432,843 | 3/1969 | Spring | 340/546 |
| 3,594,748 | 7/1971 | Grotjahn | 340/574 X |
| 3,725,892 | 4/1973 | Faltico | 340/689 X |
| 3,832,705 | 8/1974 | King et al. | 340/571 |
| 3,851,326 | 11/1974 | Costa | 340/571 |
| 3,878,539 | 4/1975 | Gooding | 340/546 |
| 4,059,299 | 11/1977 | Huntley | 116/77 X |
| 4,067,289 | 1/1978 | Joyner, Jr. | 116/77 |
| 4,194,461 | 3/1980 | Kubiatowicz | 116/77 |
| 4,227,189 | 10/1980 | Davis | 340/574 X |
| 4,262,180 | 4/1981 | Walter | 340/574 X |
| 4,262,285 | 4/1981 | Polley | 340/574 |
| 4,264,892 | 4/1981 | Zonn | 340/546 X |
| 4,264,899 | 4/1981 | Menzies et al. | 340/689 X |
| 4,284,982 | 8/1981 | Downey | 340/574 X |
| 4,326,196 | 4/1982 | Plevy | 200/61.93 X |
| 4,394,644 | 7/1983 | DiLeo et al. | 340/571 |
| 4,520,351 | 5/1985 | Altman et al. | 340/574 |

OTHER PUBLICATIONS

Radio Shack Catalog, p. 108.

Advertisement and Order Blank for Startler Alarm.

Selected advertisements on door hanger alarms, including advertisement of DOOR-ALERT, WATCHDOG Intruder Alarm and Intruder Alarm and doorknob alarm.

Advertisement of Amway door alarm.

*Primary Examiner*—James L. Rowland

*Assistant Examiner*—Thomas J. Mullen, Jr.

*Attorney, Agent, or Firm*—Kinney & Lange

[57] ABSTRACT

The invention is concerned with a personal alarm device which can be used for a variety of alarm purposes. In one application, the device is used to sound an alarm when there is an impending attack. This is accomplished, after cocking of the alarm, by simply releasing a removable member which falls away. In another application of the device, the alarm can be carried in a purse or other receptacle and is effective to sound the alarm if the purse is moved away from the hand of the user. In still another application, the device may be used to detect the opening of a window or the relative movement of two members which are normally in substantial engagement with each other. In still another arrangement, the device is used for detecting the withdrawal of the latch bolt of a door.

The device employs an electrically-operated alarm, a battery and two switches, all mounted within a housing. The first switch is biased to closed position and is normally held open by a key member which can be withdrawn to permit the switch blade to move to closed position. The key member is always ultimately withdrawn, regardless of which application the alarm is being used for. Where it is being used as a manually-carried alarm, the engagement of the hand with a release plate keeps the switch from closing. The other switch is employed in connection with several of the other applications and is connected in series with the first switch.

13 Claims, 12 Drawing Figures

Fig.10
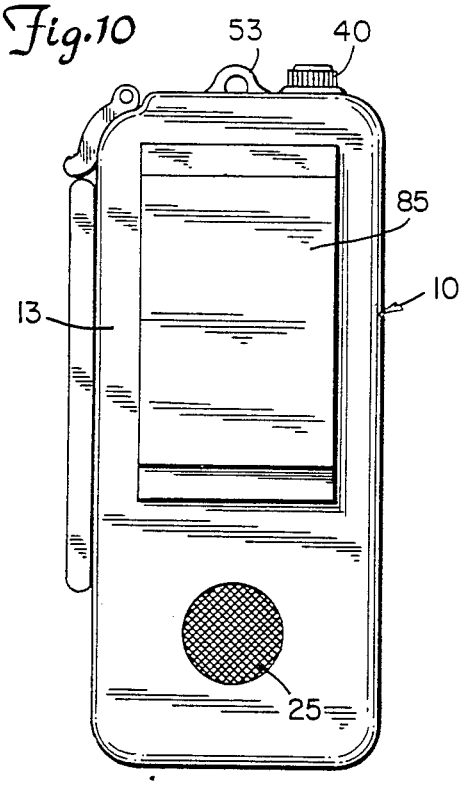
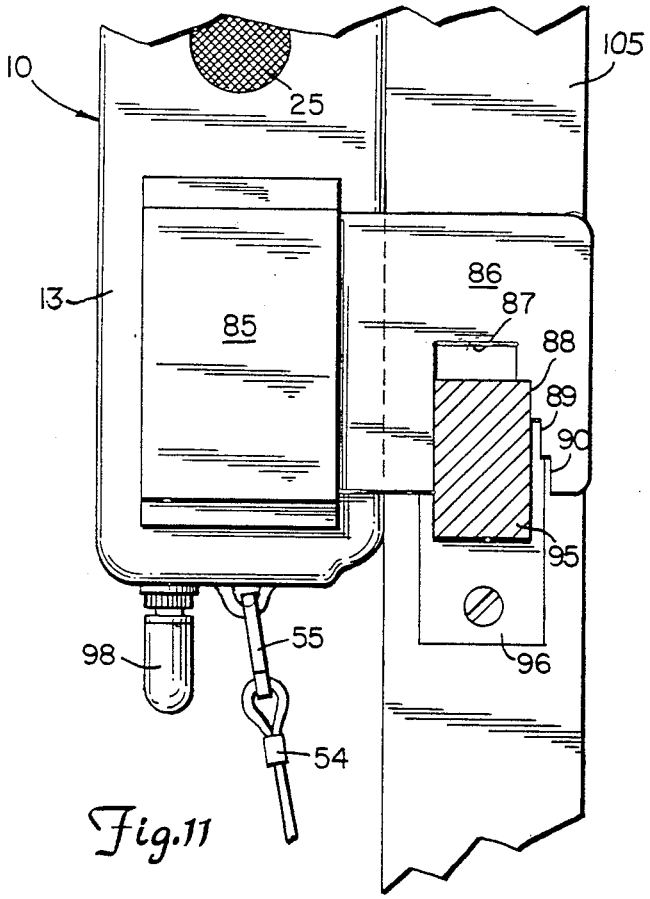
Fig.11
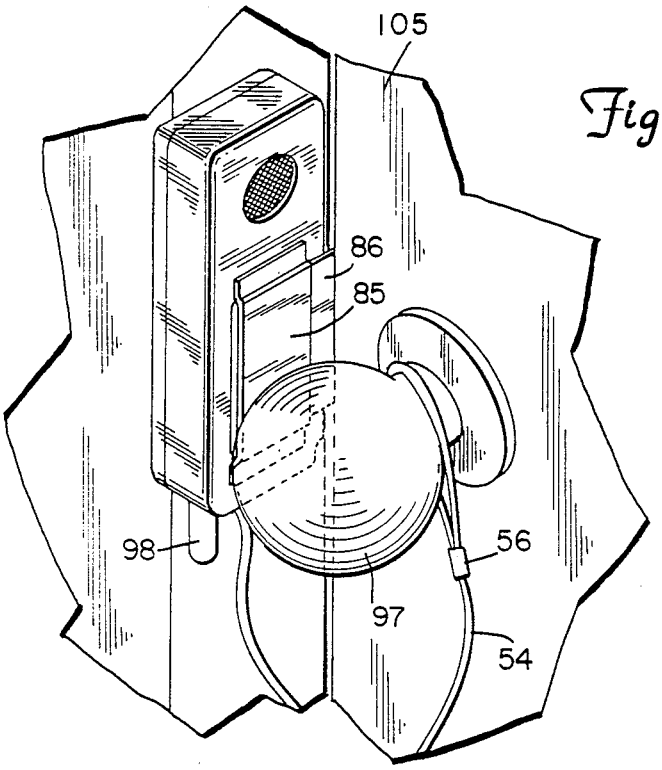
Fig.12

ALARM DEVICE

FIELD OF THE INVENTION

The present invention is concerned with a personal alarm device which can be used for a variety of alarm purposes.

BACKGROUND OF THE INVENTION

There is an urgent need for an alarm device which is simple and can be used for a variety of alarm purposes. Many patents have been granted on different alarm devices. Some of these are hand-held devices and a typical device of this type is shown in the Miethe U.S. Pat. No. 3,248,723 which is a battery-operated position responsive unit very similar to that of a flashlight. The device is primarily intended to be worn on clothing and detect the falling a person. If it is used as an attack device, it could readily be picked up by the assailant and deactivated.

The Grotjahn U.S. Pat. No. 3,594,548 does show two movable members which are normally held together and which are allowed to separate when an attack occurs. The device is a relatively expensive device and employs a radio transmitter. Furthermore, it also suffers from the drawback that an assailant could pick up the device and turn off the alarm. Furthermore, both the devices of the Miethe and the Grotjahn patents are limited in their applications and are primarily of value as a body-worn or hand-held alarm.

Numerous patents have been granted on door alarms to warn of the opening of a door. Typical of such patents are the Love U.S. Pat. No. 804,241, the D'Almaforte U.S. Pat. No. 1,567,921, the Davies U.S. Pat. No. 1,545,947 and the Davis U.S. Pat. No. 452,597. As far as the applicants are aware, all of the known devices of this type which go between a door and an adjacent jamb or other member are primarily designed for that purpose and are unadaptable for other purposes. Furthermore, they require that the door be actually moved.

SUMMARY OF THE INVENTION

The present invention is concerned with a relatively simple unit having an alarm device and an energizing means in the housing. Along with an energizing means and the alarm device in the housing is at least one control which is effective to energize the alarm under certain conditions.

The device of the present invention can be used for a variety of purposes with relatively simple modifications which can be quickly made. In all cases, there is a key member which is withdrawn when the alarm is to be actuated or made ready for actuation.

In one form of our invention, there is a releasable bar which is held in the hand and upon release, the alarm is sounded. The releasable bar under these conditions falls away so as to prevent ready disabling of the alarm by an assailant.

In another form of our invention, the device can be used as a purse alarm. The device is carried in the purse and flexible member extends from the alarm to the body of the user. If the purse is moved away from the body by an assailant, the flexible member will actuate a control to cause the alarm to be sounded.

In still another application of the present invention, a window switch having two members normally biased apart is inserted between the window and the casing or between any two objects normally in substantial engagement with each other and is effective when the window is opened or when the two objects have moved away from each other to cause the alarm to sound.

In still another application of the present invention, the device is suspended from a door latch by a member thin enough to be released if the door latch is withdrawn, even though the door is still closed. Means are provided for sensing the change in position of the alarm housing to cause actuation of the alarm under these conditions.

Various other features of the invention will be apparent from a consideration of the accompanying specification, claims and drawings.

BRIEF DESCRIPTION OF THE DRAWINGS

FIG. 10 is a rear view of the alarm device showing means by which the alarm device can be secured to a latch bolt of a door.

FIG. 11 is a view partly in section showing the device mounted over a door latch.

FIG. 12 is a perspective view showing the device in use on a latch bolt to detect withdrawal of the door latch.

DETAILED DESCRIPTION OF THE PREFERRED EMBODIMENTS

Figure 1:
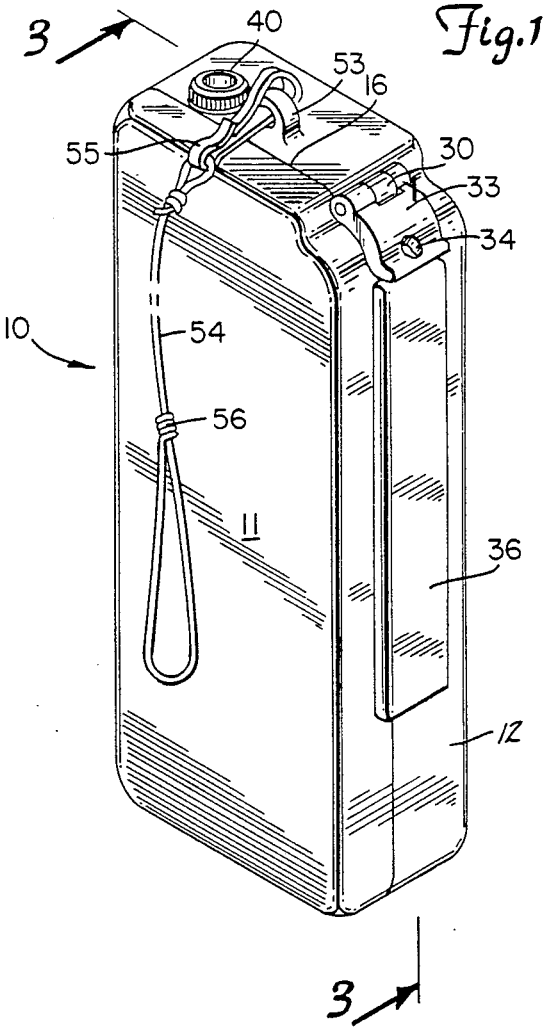
FIG. 1 is a perspective view of our improved alarm device.
Figure 2:
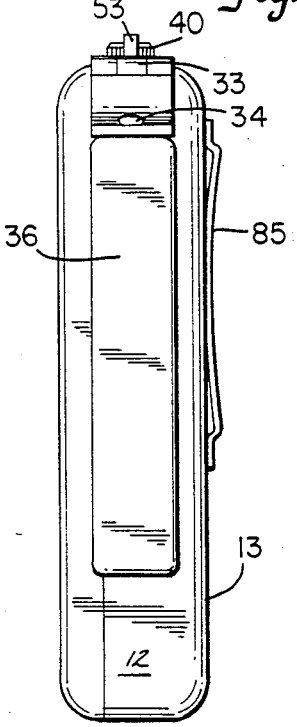
FIG. 2 is a side elevational view of the alarm device.

Referring to FIGS. 1 and 2, the alarm device is mounted in a housing generally designated by the reference numeral 10. The housing 10 has a front wall 11, a side wall 12 and a rear wall 13. There is an opposite side wall 14 (best shown in FIG. 4). The front wall 11 forms part of a removable cover which is detachably secured to the main portion of the housing along a dividing line indicated by the reference numeral 16.

Figure 3:
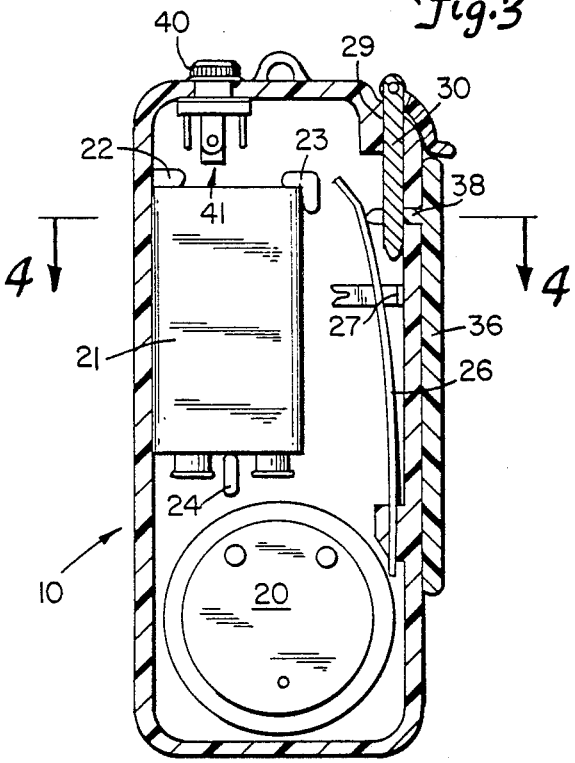
FIG. 3 is a vertical sectional view taken along the line 3—3 of FIG. 1.

Referring to FIG. 3, it will be noted that there is an alarm device 20 which may take various forms but which, in one embodiment, is an electrically-operated horn of considerable intensity. Also secured within the housing 10 is a battery 21. This may be of any suitable battery, such as a conventional 9-volt dry cell. A housing is provided with flanges 22, 23 and 24 for holding the battery in position. The rear wall of the housing, as best shown in FIG. 10, has an opening adjacent alarm 20, which opening is covered by a grill 25.

Secured to the interior of the housing is a switch blade 26 which is biased into engagement with an electrical contact 27. As will be presently explained, switch blade 26 is normally held out of engagement by contact 27, except when it is desired to either sound the alarm or to activate the alarm.

The upper wall of the housing is provided with an opening 29 designed to receive a key member 30. The key member 30 is a bar which extends downwardly along the inner portion of the side wall 12. The key member 30 has pivoted thereto a handle member 33 which has an aperture 34 through the outer portion of the handle. When it is desired to remove the key member 30, the handle 33 may be grasped and lifted up to pull out the latching member 30 from the housing.

Located adjacent the wall 12 of the housing is a hand-held releasable member 36 which is in the form of a flat bar which rests against the outer surface of side wall 12. The hand-held releasable bar 36 is provided with an inwardly extending ear 38 which has an aperture therethrough through which the bar 30 is designed to slide.

Figure 4:
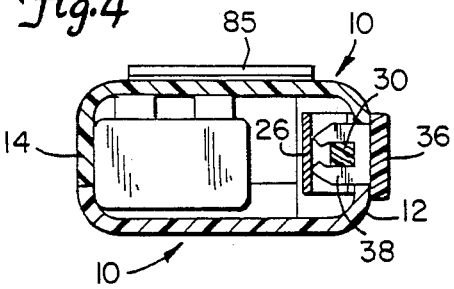
FIG. 4 is a horizontal sectional view taken along the line 4—4 of FIG. 3.

It will be noted that the inwardly extending ear 38 abuts against the switch blade 26 and holds it in a position in which the blade 26 is out of engagement with the fixed contact 27. This is best shown in FIG. 3. It will also be obvious that the key member 30, in extending through the aperture in the ear 38 of the releasable bar 36, holds this bar in the position shown in FIG. 3. In other words, the bar 30, as also shown in FIG. 4, extends through the aperture in ear 38 and prevents bar 36 from moving out. When, however, the key member 30 is pulled out, there is nothing to prevent the switch blade 26 from engaging the contact 27 and forcing the releasable plate 36 away from the housing of the alarm. In one use of the application, the plate 36 is held by engagement of the user's hand with this plate until, either by voluntary or involuntary action, the hand releases the plate 36, at which time, if the key 30 is not in position, the spring bias of switch blade 26 will not only move switch blade 26 into engagement with fixed contact 27, but will also force the plate 36 outwardly. Since the engagement of the latching member 30 with the ear 38 of the releasable plate 36 is the only means for holding the latter in position, it will be obvious that if the releasable plate 36 is released by the hand of the user, the releasable plate will drop away.

Secured in the upper wall of the housing is a switch receptacle 40. This unit houses a spring biased switch 41. In one version of the device, the switch is a double throw switch. When a suitable plug is inserted into the receptacle 40, the switch blade of switch 41 is moved from one circuit making position to another. This will be described in connection with FIG. 5.

Figure 5:
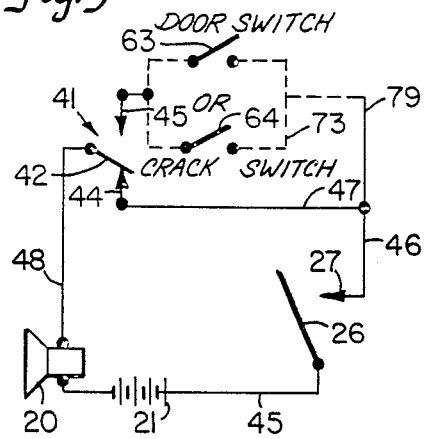
FIG. 5 is a schematic diagram showing the electrical wire in connection with our alarm device.

Referring to FIG. 5, there is shown a schematic circuit for the device. The reference numerals 20 and 21 designate the alarm and battery, respectively. It will be noted that the switch blade 26 is movable into engagement with contact 27. As previously described, switch blade 26 is biased into engagement with contact 27. The switch 41, previously referred to, is shown as having a switch blade 42 movable between a fixed contact 44 and a second fixed contact 45. The switch blade 42 is biased into engagement with the contact 44.

It will be obvious that when switch blade 26 is engaged with contact 27, to which it is biased, and switch blade 42 is engaged with contact 44, to which it is biased, an energized circuit for alarm 20 will be established from the positive terminal of battery 21 through a conductor 45, switch blade 26, contact 27, conductors 46 and 47, contact 44, switch blade 42, conductor 48, and the alarm device 20 back to the negative terminal of battery 21. Thus, with switch 41 in the position in which it is biased, it will be clear that closure of switch blade 26 against contact 27, if allowed to happen, will cause sounding of the alarm. As has been previously described, switch blade 26 cannot engage contact 27 until the key member 30 has been withdrawn and the hand-held releasable member 36 has been released.

USE OF DEVICE AS HAND-HELD ALARM

Where the device is being used as a hand-held alarm device, the key member is withdrawn while the hand engages the releasable member 36. As long as hte releasable member 36 is held by the user, nothing can happen. If, however, the person is attacked or senses an attack, all that is necessary to do is to release the releasable member 36. The releasable member will then fly away from the housing, due to the biasing action of the switch blade 26 and the switch blade 26 will move into engagement with contact 27 to close the circuit traced above in connection with FIG. 5. The alarm will now sound. Furthermore, due to the fact that the releasable member 36 has now dropped away from the housing, it would be difficult for an attempted assailant to turn off the alarm. In all probability, both the housing 10 and the releasable member 36 will be on the ground, detached from each other.

The advantage of the present device as a hand-held alarm, is that is requires no conscious action on the part of the user, except for the preparatory action of removing the key member 30. In other words, if the user senses that he or she is in a dangerous area, the key can be removed and carried in the pocket. At the same time, the user holds the releasable member 36 against the side wall of the casing. If an attempted attack occurs and the user is frightened, the user may involuntarily simply let go of the releasable member 36 to cause the alarm to be sounded. In other words, the actuation of the alarm does not require a conscious act upon the part of the user.

Figure 6:
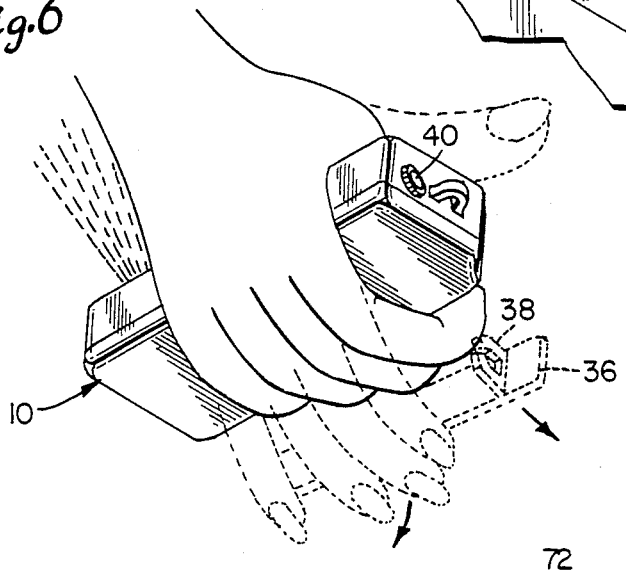
FIG. 6 is a perspective view of the device eing used as a hand-held alarm.

The action of the alarm as a hand-held alarm is best shown in FIG. 6. The position of the hand when the device is being held preparatory to a possible attach is shown in solid lines. When an attack seems imminent, the fingers of the hand are moved to the position shown in dotted lines. It will be noted that the member 36 has moved outwardly and is in the position where it can drop on the ground or floor.

It will, of course be undestood that the releasable member 36 can be held in its normal position by other means such as the weight of the alarm if the alarm is resting upon a supporting surface with the releasable member engaging the supporting surface. In such case, a movement of the alarm device will permit the release of the releasable member to sound the alarm.

USE OF DEVICE AS PURSE ALARM

Figure 7:
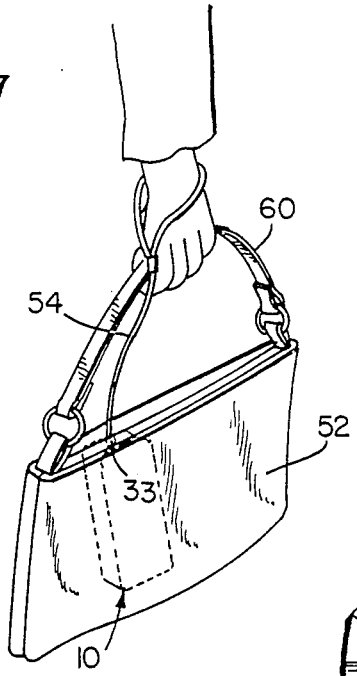
FIG. 7 is a perspective view showing the device being used within a purse and designed to emit a signal if the purse is removed from the hand of the user.

The use of the device as a purse alarm is shown in FIG. 7. The housing 10 is shown in dotted lines as being within a purse 52. Referring first back to FIG. 1, it will be noted that the housing has secured to the top wall thereof an ear 53. There is also shown a cord 54 which is secured to the ear 53 by a conventional spring clip 55. The outer end of the cord 54 is doubled back and has secured thereto a loop 56 which surrounds the main portion of the cord 54 and can be slid along the portion to adjust the size of the loop formed by the doubled up portion. Where the device is to be used as a purse alarm, as shown in FIG. 7, the spring slip 55 is released from the ear 53 and is inserted through the opening 34 of the handle 33 of the key member 30. The loop in the cord 54 is then placed around the wrist of the user who is grasping the handle 60 of the purse. If a robber removes the purse 52 by simply pulling on it or cutting the handle 60, the loop of the cord 54 will still remain around the user's wrist. As the robber or assailant attempts to remove the purse, the pull will be exerted upon the cord 54. This will result in the key member 30 being withdrawn. Since there is nothing to hold the switch blade 26 in place, the switch blade 26 will move into engagement with fixed contact 27 and the alarm will be sounded.

It will be noted that the device, when used as a purse alarm, uses basically the same elements as when it is used as a hand-held alarm, except for the cord 54. Even this cord is of assistance when the device is used as a hand-held alarm. The cord can be used until the possibility of an attack is sensed. At this time, the key will be removed and the device will be held directly by the hand, engaging the housing in the position shown in FIG. 6 in full lines.

USE OF DEVICE AS WINDOW ALARM

Figure 8:
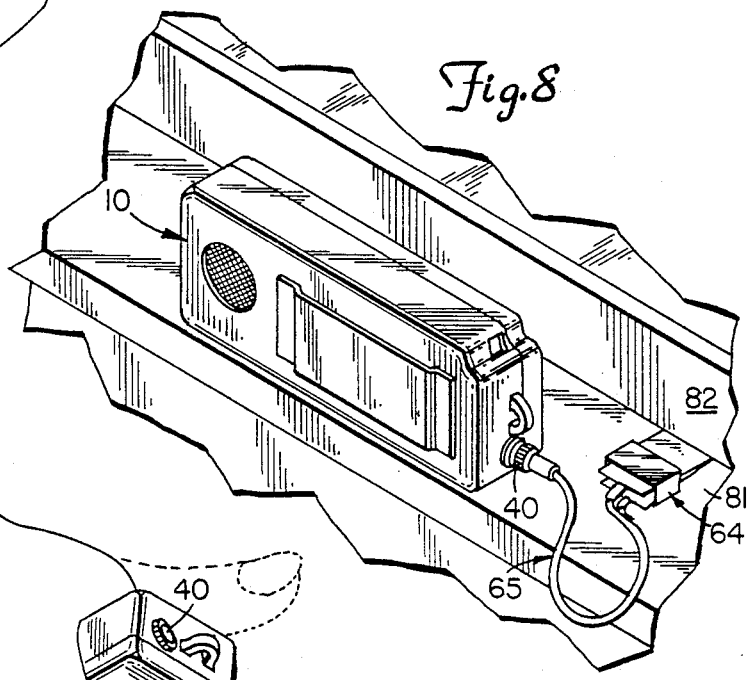
FIG. 8 is a view showing the alarm device being used to guard against the unauthorized opening of a window.
Figure 9:
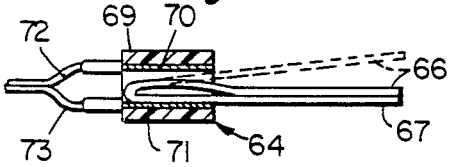
FIG. 9 is a detail of the switch device used in connection with the arrangement of FIG. 8.

The alarm device of the present invention can also be used to detect the opening of a window, or the relative movement of any other relative movable members of a building. This type of operation is shown in FIG. 8. To accomplish this, we provide a window switch unit 65 which plugs into the switch receptacle 40. When the unit is plugged into the receptacle 40, the switch blade 42, normally in engagement with contact 44, is moved into engagement with the other contact 45, referred to in connection with FIG. 5. Connected in parallel with each other and between the fixed contact 45 and conductor 46 are a pair of switches 63 and 64. Switch 63 will be referred to later. Switch 64 is a switch which is associated with the window unit 65. Unit 65 has two conductors 72 and 73 extending in engagement with two spaced contacts within the switch receptacle 40. The conductors are in series with fixed contact 45 and conductor 46. At the end of the unit 64 there are two spaced spring members 66 and 67 which are biased apart. The separated position of spring member 66 is shown in dotted lines in FIG. 9. Both the spring members 66 and 67 are preferably formed of a unitary resilient member which is in the form of an elongated U-shaped member, the bend of which is disposed within a sleeve 69. The sleeve 69 is of insulating material and has two conductive inserts 70 and 71 which are connected in turn to conductors 72 and 73, which extend into the receptacle 40 in the manner previously described. A suitable insulating covering covers these two conductors which in turn are insulated from each other. When the resilient leg 66 is allowed to spring out to the dotted line position shown in FIG. 9, it moves into conductive relationship with the conductive member 70 and establishes a conductive connection between conductive members 70 and 71 and hence between conductors 72 and 73. This will establish a circuit from battery 21 through the switch blade 26, conductor 46, conductors 79 and 73, switch 64, conductor 72, fixed contact 45, switch blade 42 and conductor 48 to the alarm 20.

In use, the two spring members 66 and 67 are pressed together and inserted between two relatively movable members of a building enclosure such as the sill 81 and the frame 82 of a window. When the window is closed downwardly, the blades 66 and 67 are held together. If the window is opened, the two blades will move apart due to the bias of blade 66. This causes blade 66 to move into contact with conductor 70 as previously described and to complete the circuit just traced.

While we have described the switch 64 as being inserted between two movable members of a window, it is also understood that it can be placed in other locations where relative movement is to be detected. In fact, it could even be placed between a floor and an object resting on the floor. Generally, the idea is that the blades are held together except when the condition is produced which indicates possible theft.

Again, it will be noted that the device uses the same basic unit.

USE OF DEVICE AS DOOR-MOUNTED INTRUSION DETECTOR

The device of the present invention is designed to not only guard against the opening of a door, but even turning a bolt or latch preparatory to one entering the room. Referring to FIGS. 2, 4 and 10, a resilient clip 85 is secured to the back wall 13 of the housing 10. This clip, as best shown in FIG. 2, is firmly secured at its ends to the housing and is bowed inwardly at its midpoint. The clip 85 is of resilient material and thus tends to be biased inwardly towards the wall 13 of the housing 10. A notched plate 86 is provided with a series of notches 87, 88, 89 and 90 of progressively increasing width. This is accomplished by having one wall of the notch stepped. The reason for this is to provide for the plate resting over any of various size bolts of a door latch or a retractable bolt for a door. The member 86 is formed of relatively thin material and the unnotched main body portion (to the left in FIG. 11) is inserted between the inwardly bowed portion of the clip 85 and the wall 13, as best shown in FIG. 11. The member 86 is thin enough to slip freely between a typical door and a door jamb, this being shown in FIG. 12 in which the door is indicated by the reference numeral 95 and the door jamb by the reference numeral 96. The notched portion of the plate 86 is slipped over a latch bolt 95 of a typical door latch. Instead of the typical spring-biased door latch which goes through an opening in a latch plate 96 secured to the door, the device may equally well be placed over a dead bolt. Because the plate 86 is of very thin material, the housing 10 is supported entirely from the latch bolt 95 and is not supported by reason of any frictional engagement between the door, the plate 86 and the door jamb. The result of this is that if the latch bolt is withdrawn, the unit 10 drops, even though the door has not been opened. The advantages of this will be discussed later.

In FIG. 1, there was shown a cord 54 which was secured to an eye 53 at the top of the unit. This cord 54 is employed with the arrangement in which the alarm device is used as to detect withdrawal of a latch bolt. A portion of the cord is shown as 54 in FIG. 11 and in FIG. 12 the loop of the cord is shown as being hooked over the shank of a door knob 97.

A mercury switch 98 is secured within the switch socket 40, previously discussed. This switch is of the type which is gravity-responsive and is normally in switch open position. Before the switch is inserted, the unit 10 is inverted to the position shown in FIGS. 11 and 12. When the switch is in this position, the contacts are open. When it is in either a horizontal position or a position reversed to that shown in FIG. 11, the contacts are closed by the mercury in the switch bridging some contacts in the switch. Referring to FIG. 5, the switch 98 is shown in the circuit. This switch is shown for purposes of simplicity as having a switch blade 63 which is normally spaced from an associated contact but which is closed upon the attitude of the mercury switch being changed. When the mercury switch is inserted, the switch blade 42 within the socket 40 is moved from engagement with contact 44 against the bias of the switch to contact 45. Just as with the crack switch 64, a potential energizing circuit for the alarm 20 is established. This takes place whenever switch 98 is closed. Since switch 98 is parallel with switch 64 and this circuit has already been traced, it is unnecessary to trace it in this case.

Referring now to the overall operation of the apparatus of FIGS. 10–12, the plate 86 is slipped over a latch bolt 95 or a dead bolt. The plate 86 is adjusted so that the bolt 95 enters the smallest of the notches 87, 88, 89 and 90 into which it will fit. One of the four notches will fit reasonably snugly over the latch bolt 95 so that the housing 10 will be adequately supported by the latch bolt. The loop of the cord 54 is now placed over the door knob and the slide 56 is adjusted so that the loop is smaller than the door knob 97 and will not slip off the door knob.

With the alarm in place, if an attempted intruder withdraws the latch bolt 95, the housing 10 will drop. While it will not reach the floor because of the restraining influence of the cord 54, it will remain in an inverted position with respect to that in which it is in in FIGS. 11 and 12. In this position, the mercury switch 98 will be at the top of the unit. In this position, the switch 98 is closed to energize the circuit referred to in connection with FIG. 5.

The advantage of the present arrangement is that it does not depend upon opening of the door. As long as the latch bolt is merely withdrawn, the alarm will be sounded. Thus, an attempted intruder may be frightened away before he even opens the door. As soon as he retracts the latch bolt, the alarm will be sounded and he will be aware that the occupant of the room has been alerted as to his attempted intrusion. Even if the fit between the door and the jamb is so close that the housing does not drop when the latch bolt is withdrawn, the housing will still drop to sound the alarm when the door is opened.

CONCLUSION

It will be seen that we have invented an alarm device which is extremely adaptable for use in a variety of situations. As a hand-held device, it requires no positive action of the part of the user. If the user lets go of the device or a portion of it, the two parts of the unit separate and the alarm is sounded. Where it is used as a purse alarm, the purse can be removed from the individual carrying it, but the alarm will still be sounded since it is attached by a cord to the wrist of the user. Where it is used as an alarm for detecting relative movement of two objects, such as a window and a window casing, very little modification is required. All that is necessary to do is to use a switch having two blades which are biased apart and which are held together when the objects are in engagement, for example, when the window is closed. This switch is connected to a conductive cord which in turn has a plug adapted to be connected into a switch receptacle in the housing. Where the device is used as a door alarm, it is only necessary to make some simple modifications of the device and the alarm will function not only to detect the opening of the door, but even the withdrawal of the latch bolt prior to opening of the door.

The alarm device of the present invention has the advantage that once it is actuated, it is very difficult for it to be turned off by one who is not familiar with the operation of the device. Where the device is used as a hand held device, as shown in FIG. 6, the releasable bar 36 and the housing 10 fall to the ground. Before the alarm can be turned off, these pieces have to be picked up and properly reassembled. A would-be assailant is apt to be very reluctant to stay around long enough to pick up a piece and try to reassemble it with a unit. In the arrangement of FIG. 7 where the device is used as a purse alarm, the key 30 will be retained by the wearer by means of the cord 54. Thus, if the purse is removed, the only way that the alarm can be turned off is to attempt to get the key 30 and reinsert this into the unit. In all of the confusion, this is highly unlikely. In the door alarm of FIGS. 10 through 12, when the alarm device drops due to the latch bolt 95 being withdrawn, it would be necessary to pick up the unit not suspended by the cord 54 and turn it upside down in order to turn off the alarm. Thus, in each case, particularly with the modifications of FIGS. 6 through 12, the alarm cannot be readily turned off once it has been actuated.

While we have shown certain specific embodiments for purposes of illustration, it is to be understood that the scope of the invention is limited solely by the appended claims. Workers skilled in the art will recognize that changes may be made in form and detail without departing from the spirit and scope of the invention.

What is claimed is:

1. A personal alarm device comprising:
a housing;
a battery and an electrically-operated alarm in the housing;
a switch in the housing biased to closed position;
an energizing circuit for the alarm including the battery and the switch;
a hand-held releasable member outside of and adjacent a side wall of the housing and having a portion projecting inwardly through the housing into operative engagement with the switch and biased away from the housing by reason of the biasing force of the switch;
the housing having an opening therein spaced from the releasable member and adjacent the switch for the reception of a removable key member; and
a key member slidably insertable through the opening into operative engagement with the switch and with the inwardly projecting portion of the hand-held releasable member to hold the switch in switch open position against its bias and to retain the releasable member against the side wall of the housing, the switch tending to move to closed position to energize the alarm and the hand-held releasable member tending to move away from the housing when the key member is withdrawn, said hand-held releasable member being engageable by the hand of a user to hold the releasable member against the housing and to prevent closure of the switch.

2. The alarm device of claim 1 in which the engagement between the key member and the inwardly projecting portion of the releasable member is the only means other than pressure on the releasable member for retaining the releasable member against the housing so that upon withdrawal of the key member and release of the releasable member, the releasable member will separate from the housing.

3. A personal alarm device comprising:

a housing;

an alarm in the housing and means also in the housing for energizing the same;

a control for the alarm and biased to a position in which the energizing means is effective to operate the alarm;

a hand-held releasable member outside of and adjacent a side wall of the housing and having a portion projecting inwardly through the housing into operative engagement with the control and biased away from the housing by reason of the biasing force of the control;

the housing having an opening therein spaced from the releasable member and adjacent the control for the reception of a removable key member; and a key member slidably insertable through the opening into operative engagement with the control and with the inwardly projecting portion of the hand-held releasable member to hold the control against its bias in a position in which the energizing means is ineffective to operate the alarm and to retain the releasable member against the side wall of the housing, the control tending to move to a position in which the alarm is energized and the hand-held releasable member tending to move away from the housing when the key member is withdrawn, said hand-held releasable member being engageable by the hand of a user to hold the releasable member against the housing and to prevent the control assuming a position in which the alarm is operated.

4. The alarm device of claim 3 in which the engagement between the key member and the inwardly projecting portion of the releasable member is the only means other than pressure on the releasable member for retaining the releasable member against the housing so that upon withdrawal of the key member and release of the releasable member, the releasable member will separate from the housing.

5. The alarm device of claim 3 in which the alarm is an electrically-operated alarm and the means for energizing the same is a battery, and the control is a switch in the energizing circuit for the battery.

6. A personal alarm device comprising:

a housing:

an alarm in the housing and means also in the housing for energizing the same;

a control for the alarm and biased to an active position in which the energizing means is effective to operate the alarm;

a releasable member extending through a wall of said housing and having a portion projecting inwardly through the housing into operative engagement with the control to hold it away from its active position, said releasable member being biased away from the housing;

the housing having an opening therein spaced from the releasable member and adjacent the control for the reception of a removable key member;

a key member slidably insertable through the opening into operative engagement with the control and with the inwardly projecting portion of the releasable member to hold the releasable member adjacent the housing and to hold the control against its bias in a position in which the energizing means is ineffective to operate the alarm; and a flexible member and secured at one end to said key member and designed to be secured at its other end to the body of the user so that if the alarm device is moved away from the body of the user, the key member will be slidably withdrawn to cause the alarm to be energized.

7. A personal alarm device comprising:

a housing;

an alarm in the housing and means also in the housing for energizing the same;

a control for the alarm secured to said housing and operative when the housing is moved to cause the energizing means to energize said alarm; and a thin plate secured to said housing and designed to be inserted between a closed door and the adjacent door jamb and to engage the latching bolt of the door to support the housing from the latching bolt, said plate being thin enough so that when the latch bolt is withdrawn, the housing will drop and cause the control to cause energization of the alarm.

8. The alarm device of claim 7 in which the control is an attitude responsive control responsive to a change in attitude of the housing from a predetermined attitude.

9. The alarm device of claim 7 in which the thin plate is notched to extend over a latch bolt.

10. The alarm device of claim 7 in which the thin plate is detachably secured to the housing so that it can be withdrawn when the alarm device is to be used for other alarm purposes.

11. A personal alarm device comprising:

a housing;

a battery and an electrically-operated alarm in the housing;

a first switch in the housing biased to closed position;

a second switch in the housing biased to closed position;

an energizing circuit for the alarm including the battery and both the first and second switches;

the housing having an opening therein adjacent the first switch for the reception of a removable key member;

a key member insertable though the opening into operative engagement with the first switch to hold it in switch open position against its bias, the first switch tending to move to closed position when the key member is withdrawn so as to tend to close the circuit to the alarm through the first and second switches;

alarm controlling means including a normally open attitude responsive switch associated with the second switch for preventing closure of the circuit through the alarm despite withdrawal of the key member until a change in attitude of the housing occurs to cause closure of the circuit through the alarm; and said alarm device housing being provided with means for insertion between a door and an adjacent door jamb and designed to engage over a retractable latching member to support the housing from the retractable latching member, said housing being released as a result of the latching member being retracted to change the attitude of the housing.

12. A personal alarm device comprising:

a housing;

an alarm in the housing and means in the housing for energizing the same;

a control for the alarm secured to said housing and operative when the housing is moved to cause the energizing means to energize said alarm; and a thin member secured to said housing and designed to be inserted between a closed door and the adjacent door jamb and to engage the latching bolt of the door to support the housing from the latching bolt, said thin member being thin enough so that when the latch bolt is withdrawn, the housing will drop and cause the control to cause energization of the alarm; and a cord secured to the housing and having a loop at one end to fit over the door knob of a door.

13. The alarm device of claim 12 in which the thin member is notched to extend over a latch bolt.

* * * * *

UNITED STATES PATENT AND TRADEMARK OFFICE

CERTIFICATE OF CORRECTION

PATENT NO. : 4,633,232

DATED : December 30, 1986

INVENTOR(S) : Frederic P. Nelson and John R. Jamieson

It is certified that error appears in the above-identified patent and that said Letters Patent is hereby corrected as shown below:

In column 6, lines 38-39, delete "95 and the door jamb by the reference numeral 96" and substitute therefor --105--.

Signed and Sealed this

Twenty-ninth Day of March, 1988

*Attest:*

DONALD J. QUIGG

*Attesting Officer*

*Commissioner of Patents and Trademarks*